US006993891B2

(12) United States Patent
Richardson et al.

(10) Patent No.: US 6,993,891 B2
(45) Date of Patent: Feb. 7, 2006

(54) WASTE DISPOSAL SYSTEM WITH FLEXIBLE TUBING

(76) Inventors: Bobbi Sue Richardson, 4562 Leathers St., San Diego, CA (US) 92117; Kim Marie Lindner, 7101 Astoria St., San Diego, CA (US) 92111

( * ) Notice: Subject to any disclaimer, the term of this patent is extended or adjusted under 35 U.S.C. 154(b) by 105 days.

(21) Appl. No.: 10/817,268

(22) Filed: Apr. 3, 2004

(65) Prior Publication Data

US 2005/0217214 A1 Oct. 6, 2005

(51) Int. Cl.
*B65B 9/10* (2006.01)

(52) U.S. Cl. ..... 53/567; 53/526; 53/576; 53/370

(58) Field of Classification Search ..... 53/370, 53/459, 526, 567, 576, 577; 220/495.05, 220/495.06

See application file for complete search history.

(56) References Cited

U.S. PATENT DOCUMENTS

| | | | | |
|---|---|---|---|---|
| 4,869,049 | A * | 9/1989 | Richards et al. | 53/459 |
| 5,520,303 | A | 5/1996 | Bernstein et al. | |
| 5,655,680 | A | 8/1997 | Asbach et al. | |
| 5,813,200 | A | 9/1998 | Jacoby et al. | |
| 6,370,847 | B1 | 4/2002 | Jensen et al. | |
| 6,612,099 | B2 | 9/2003 | Stravitz | |
| 6,804,930 | B2 * | 10/2004 | Stravitz | 53/567 |
| 6,851,251 | B2 * | 2/2005 | Stravitz | 53/567 |

* cited by examiner

*Primary Examiner*—John Sipos

(57) ABSTRACT

A waste disposal system with flexible tubing comprising a container defining a waste chamber; a lid connected to the container and movable between an open condition and a closed condition; an iris with a first disk, a second disk and a web connecting the disks; a cartridge of flexible tubing removably situated in the container, extending from the cartridge through the iris into the waste chamber and positioned to receive waste therein; and a guide system, causing the iris to close by rotating one disk in relation to the other, thereby twisting and cinching the flexible tubing and enclosing the held waste, the guide system further causing the iris to displace in a direction opposite to the lid and to carry the held waste into the waste chamber.

19 Claims, 4 Drawing Sheets

WASTE DISPOSAL SYSTEM WITH FLEXIBLE TUBING

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention relates generally to the field of disposing of odoriferous waste, and more specifically to waste disposal system with flexible tubing.

Certain types of wastes generate offensive odors that may be difficult to control in a closed environment, such as a home, a hospital, a restaurant or an office. Examples of these wastes include soiled absorbent articles like diapers, adult incontinence products or sanitary napkins; animal droppings; putrefying foods; and combustion products.

A number of containers for the disposal of odoriferous materials are known in the prior art. These containers generally comprise a waste chamber that can be accessed by removing a lid; a bag within the chamber for holding the odoriferous material; and a constrictor system for maintaining the bag closed, in order to prevent the emission of odors.

More recently, a flexible tubing system has been developed that facilitates the use of containers for odoriferous materials. This flexible tubing system essentially comprises a ring-shaped cartridge, within which a continuous flexible tube is stored. The cartridge is positioned in an appropriate lodging at the mouth of the container and the tube is then extended into the waste chamber. After each load of waste is thrown into the flexible tubing, the portion of the flexible tubing holding the waste is closed by twisting or by other means, encapsulating the held waste. A new load of waste can then be thrown into the flexible tubing repeating the process.

The containers in the prior art have been disclosed in a number of patents but exhibit a number of deficiencies. For instance, U.S. Pat. No. 5,520,303 to Bernstein et al. discloses a diaper pail having a lid, a trash bag and a rotating ring-shaped flange at the mouth of the bag that causes the mouth of the bag to twist. This container is not suitable for use with flexible tubing and operation of this container, including the rotation of the flange, is entirely manual.

U.S. Pat. No. 5,655,680 to Asbach et al. discloses a container suited for use with a trash bag, the mouth of which is closed by a constrictor system that includes two rotating disks connected by straps. The mouth of the bag is closed by the intersection of the straps when the disks are rotated relative to each other by 180 degrees or more. This container, however, is not suited for use with flexible tubing, does not prevent emission of odors when the constrictor is opened to insert new waste, and the operation of the constrictor system is entirely manual.

U.S. Pat. No. 5,813,200 to Jacoby, Hickman and Gallo discloses a disposal system for use with flexible tubing, wherein rotation of a ring-shaped flange at the mouth of the container causes the flexible tubing to twist and to encapsulate the held waste. This container is entirely hand-operated and laborious to use. For instance, in the case of a diaper pail, a mother must rotate the flange by hand and then push the twisted tubing inside the waste chamber while holding a baby. This is not only inconvenient, but also potentially dangerous because the various steps required to operate this container must be balanced with the care of the baby.

U.S. Pat. No. 6,370,847 to Jensen et al. discloses a diaper disposal container with flexible tubing and with a rotating inner lid. This invention also requires that waste be pushed into the container by hand.

U.S. Pat. No. 6,612,099 to Stravitz discloses a waste disposal device using flexible tubing, wherein the flexible tubing is twisted by means of a rotating ring-shaped flange that is turned when the hinged lid is closed. This device is of complex construction and also requires that the twisted section of the flexible tubing be pushed into the container by hand.

BRIEF SUMMARY OF THE INVENTION

Disclosed herein is a waste disposal system with flexible tubing, and more specifically a waste disposal system with flexible tubing wherein an iris, comprising disks connected by a web, twists and cinches a portion of flexible tubing holding waste and also carries the held waste into a waste chamber in a single operation.

In one embodiment of the invention, a waste disposal system with flexible tubing comprises a container defining a waste chamber; a lid connected to the container and movable between an open condition, in which access to the container is provided, and a closed condition, in which the container is covered; an iris comprising a first disk, a second disk and a web, wherein the first disk and the second disk are ring shaped, parallel and coaxial, and wherein the web connects the first disk and the second disk; a cartridge of flexible tubing removably situated in the container, wherein the flexible tubing extends from the cartridge through the iris into the waste chamber and is arranged to receive waste therein; and a guide system, causing the iris move from the open position to the closed position by generating a relative rotation between the first disk and the second disk, further causing the iris to twist and cinch the flexible tubing and to enclose the held waste, and still further causing the iris to displace in a direction opposite to the lid and to carry the held waste into the waste chamber.

In accordance with other embodiments of the invention, the waste disposal system with flexible tubing of the first embodiment can further comprise an actuator connected to the lid to open and a fastening device to permanently fasten the flexible tubing.

There is further disclosed a process for disposing waste comprising the steps of providing a container comprising a lid, a flexible tubing, and an iris comprising two concentric and parallel disks connected by a web; of placing waste into the flexible tubing; of causing the disks of the iris to rotate angularly in relation to each other, thereby enclosing the held waste; and of causing the iris to displace in a direction opposite to the lid, thereby moving the held waste into the container.

It is one advantage of the present invention to provide a waste disposal system with flexible tubing that is simple to use and that can be operated with a single hand.

It is another advantage of the present invention to provide a waste disposal system with flexible tubing that does not require the user to push the waste into the waste chamber by hand or with a separate tool.

It is a further advantage of the present invention to provide a waste disposal system with flexible tubing wherein the flexible tubing is twisted and cinched by an iris that comprises disks rotating 120 degrees or less.

It is yet another advantage of the present invention to provide a waste disposal system with flexible tubing that is simple to construct.

It is still another advantage of the present invention to provide a waste disposal system with flexible tubing that can be expanded to include a variety of constructive option, such as a lid actuator and devices for permanently fastening the flexible tubing.

Other objects and advantages of the present invention will become apparent from the following descriptions, taken in connection with the accompanying drawings, wherein, by way of illustration and example, embodiments of the present invention are disclosed.

BRIEF DESCRIPTION OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of embodiments of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
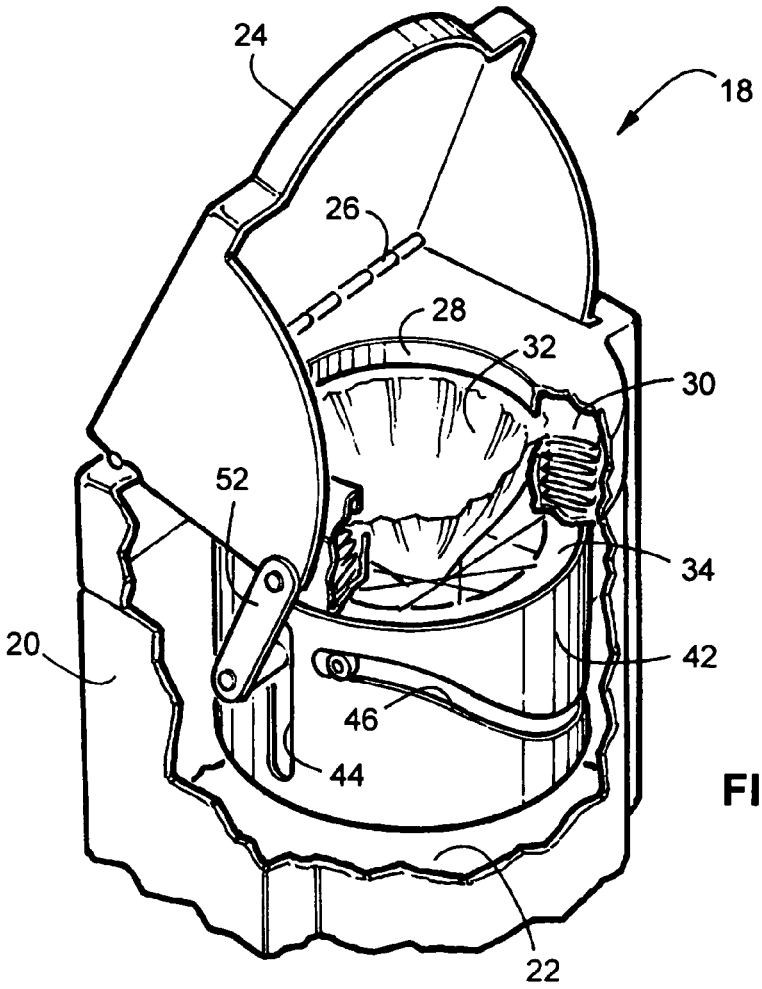
FIG. 1 is a partially cut-away perspective view of one embodiment of the invention.
Figure 2:
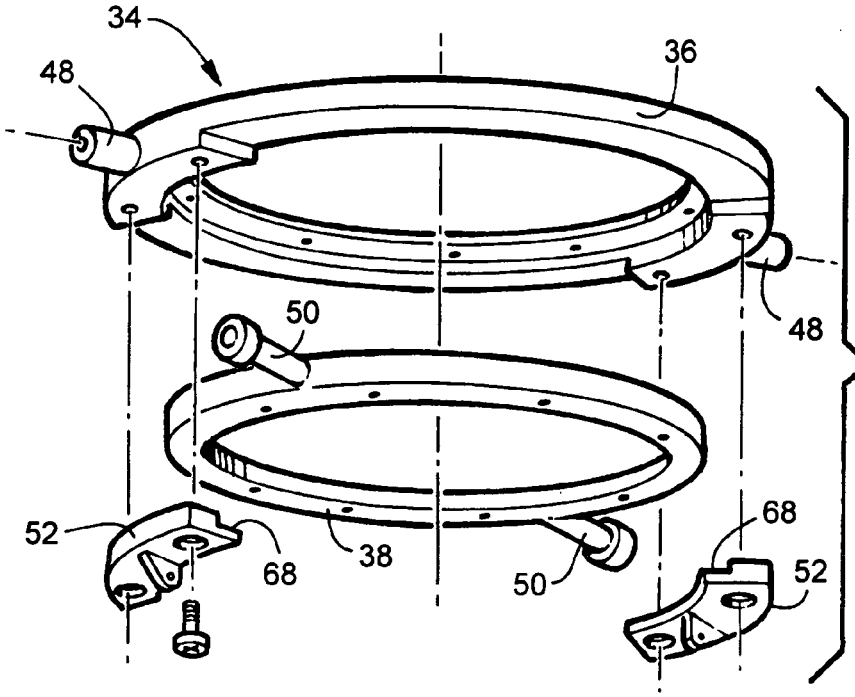
FIG. 2 is an exploded view of the iris, wherein the web connecting the iris disks is not shown.

FIG. 1 illustrates a first embodiment of the invention. A container 20 defines a waste chamber 22 for the storage of odoriferous waste. A lid 24 is movably attached to the container 20 by means of hinges 26. When lid 24 is open, the mouth 28 of waste chamber 22 is open to the external environment and access to waste chamber 22 is provided. When lid 26 is closed, mouth 28 is covered and waste chamber 22 is closed to the external environment.

Container 20 may be of different dimensions. For instance, if the invention is used for the disposal of soiled diapers, container 20 may be of a size that is suitable for storing inside a cabinet, or, conversely, of a height comparable to the height of a baby-changing table.

A cartridge 30 of flexible tubing 32 is located within an appropriate lodging in container 20 near mouth 28. Cartridges 30 of flexible tubing 32 are already known in the prior art, and flexible tubing 32 can be tailored to exhibit a variety of characteristics, such as different gauge thicknesses, different degrees of resiliency, or an inner surface with adhesive properties that maintain the flexible tubing closed when it is cinched.

Flexible tubing 32 extends from cartridge 30 into waste chamber 22. An iris 34 is positioned between cartridge 30 and waste chamber 22. As illustrated in FIGS. 2, 5A, 5B, 10A and 10B, iris 34 comprises a first disk 36, a second disk 38 and a web connecting first disk 36 and second disk 38. This web comprises a plurality of parallel string segments 40, each of which connects a point 54 on the first disk 36 with a point 56 on second disk 38 at a specified angular distance. Each string segment 40 may be a portion of a continuous string connecting first disk 36 to second disk 38, or may be a separate string piece that is not connected to any other string segment 40. In other embodiments, different web types may be employed, for instance, a net or a mesh.

Iris 34 is housed within a cylindrical structure 42, which comprises two slots 44 running parallel to the longitudinal axis of cylindrical structure 42 and also two grooves 46 running along the wall of cylindrical structure 42 in a spiral pattern. Two first pins 48 extend from first disk 36 and are each housed in one of slots 44. Two second pins 50 instead extend from second disk 38 and are each housed in one of grooves 46.

First disk 36 and second disk 38 are connected longitudinally by retainers 42, which force the two disks to move simultaneously in the direction of their common longitudinal axis, but which also allow the two disks to rotate relative to each other. In this embodiment, second disk 38 has a smaller diameter than first disk 36 and is supported by lips 68 of retainers 42. This allows second disk 38 to rotate relative to first disk 36 and retainers 42, once attached to first disk 36, to maintain an outer circular surface that is flush with the outer circular surface of first disk 36.

First pins 48 are joined to lid 24 by means of link plates 52, which force iris 34 to reside near mouth 28 when lid 24 is in the open position. At this stage, iris 34 is open and allows waste to pass from mouth 28 through iris 34 and into flexible tubing 32. When lid 24 is then closed, link plates 52 cause first pins 48 to slide along slots 44 in a direction opposite to lid 24, thereby causing first disk 36 and second disk 38 to move in the direction of waste chamber 22. In turn, second disk 38 is forced to rotate in the direction of second grooves 46, extending string segments 40 and closing iris 34.

As iris 34 is closed and moves in the direction of waste chamber 22, flexible tubing 32 becomes twisted and cinched in the proximity of iris 34, encapsulating the waste material and entrapping the odors emanating from the waste.

As iris 34 moves towards the inside of container 20, the waste is carried into waste chamber 22 and cartridge 30 dispenses an additional amount of flexible tubing 32. When lid 24 is completely closed, iris 34 is in the closed position and at the maximum distance from lid 34, while flexible tubing 32 between cartridge 30 and iris 34 has assumed a funnel shape, ready to receive waste when lid 24 is opened.

The process for disposing of the odoriferous waste, therefore, comprises the steps of opening lid 24; of placing waste (for instance, a soiled diaper) in flexible tubing 32; and of closing lid 24, causing iris 34 to close encapsulating the waste and to carry the waste into waste chamber 22.

When a new cartridge 30 of flexible tubing 32 is inserted in the appropriate lodging of container 30, the first end of flexible tubing 32 to extend from cartridge 30 must be fastened, in order to provide a closed area within which to encapsulate the first load of waste. Such fastening may be accomplished in a variety of ways, for instance, by knotting the first end of flexible tubing 32, or tightening flexible tubing 32 with a mechanical clasp or with a metal wire tie, or by wrapping the first end of flexible tubing 32 around a hook extending from an inner wall of container 20.

Figure 5A:
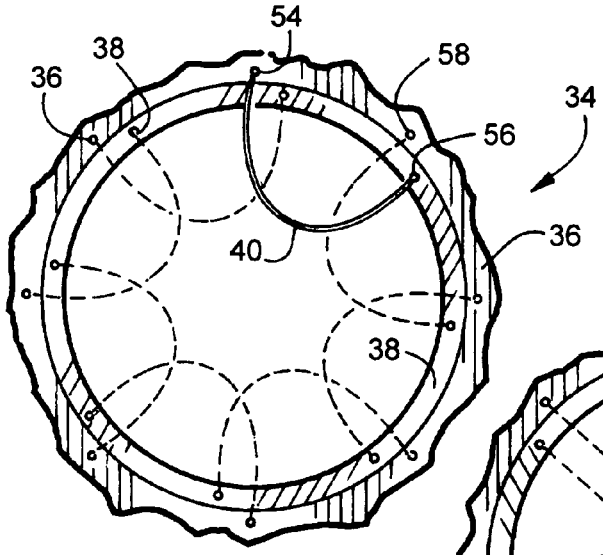
FIG. 5A is a schematic diagram of the iris in the open position.
Figure 5B:
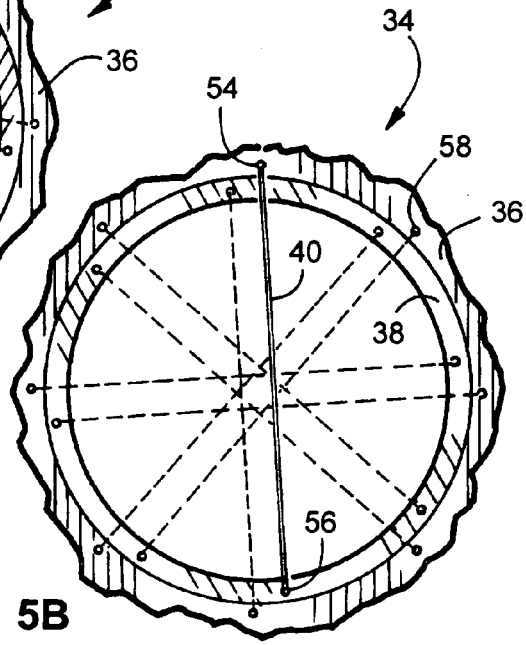
FIG. 5B is a schematic diagram of the iris in the closed position.

In accordance with the present invention, the ends of string segment 40 connecting first disk 36 with second disk 38 may be angularly spaced. FIGS. 5A and 5B illustrate one string segment 40 connecting point 54 on first disk 36 to point 56 on second disk 38 at an angular distance of approximately 70 degrees. Instead, the angular distance between two successive string segments 40, indicated in FIG. 5A as the angular distance between point 54 and point 58, is 45 degrees in the present embodiment. This arrangement maximizes the efficiency of iris 34, because an angular rotation of second pin 50 by 110 degrees allows an angular separation of points 54 and point 56 of approximately 180 degrees, closing iris 34. Other embodiments of the invention may include different angular separations between point 64 and point 56, and between point 58 and point 56.

Figure 3:
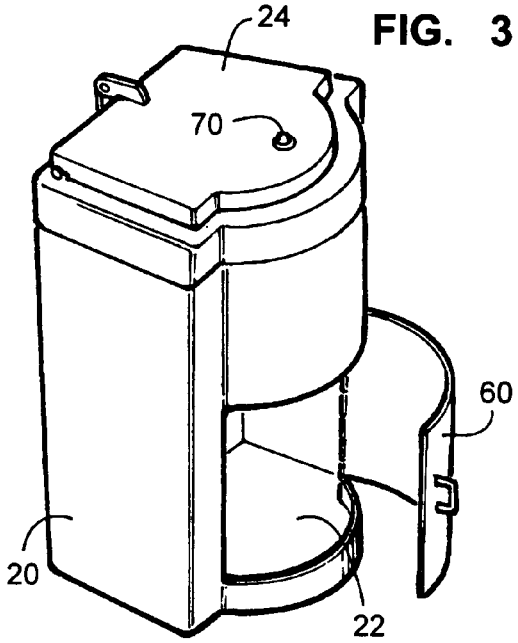
FIG. 3 is perspective view of another embodiment of the invention.
Figure 4:
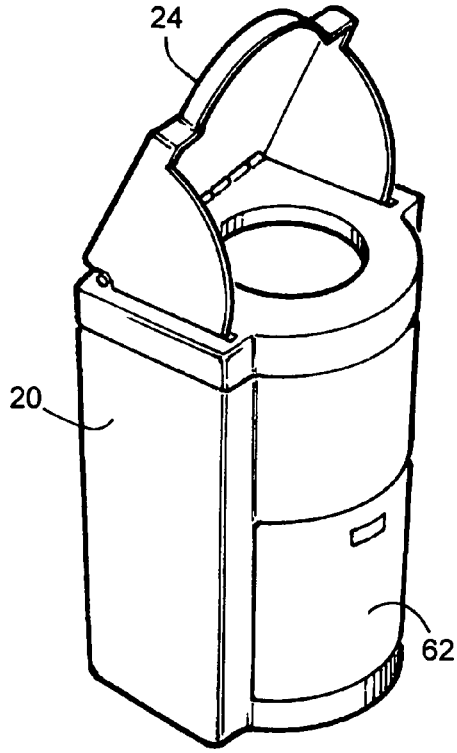
FIG. 4 is a perspective view of a further embodiment of the invention.

Turning now to FIG. 3, flexible tubing 32, when filled, can be removed from waste chamber 22 by opening a container door 60. In other embodiments, waste chamber 22 can be emptied by accessing waste chamber 22 in other ways, for instance, as shown in FIG. 4, by means of a drawer 62.

The embodiments described thus far operate entirely with mechanical energy. Although the embodiments previously described are very simple to operate, because the user is required only to open and close lid 24, the use of the invention can be further facilitated by introducing additional components in other embodiments.

Figure 6:
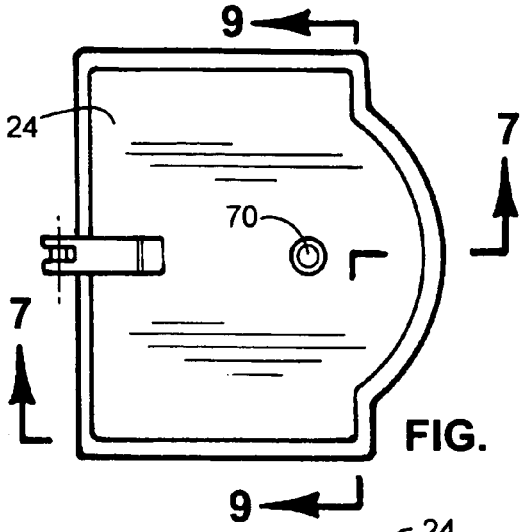
FIG. 6 is a top view of yet another embodiment of the invention.
Figure 7:
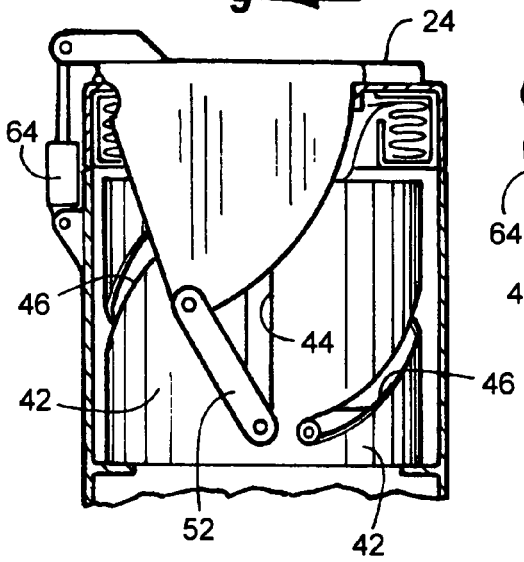
FIG. 7 is a partially cut-away view of the embodiment of FIG. 6, when the lid is in a closed condition.
Figure 8:
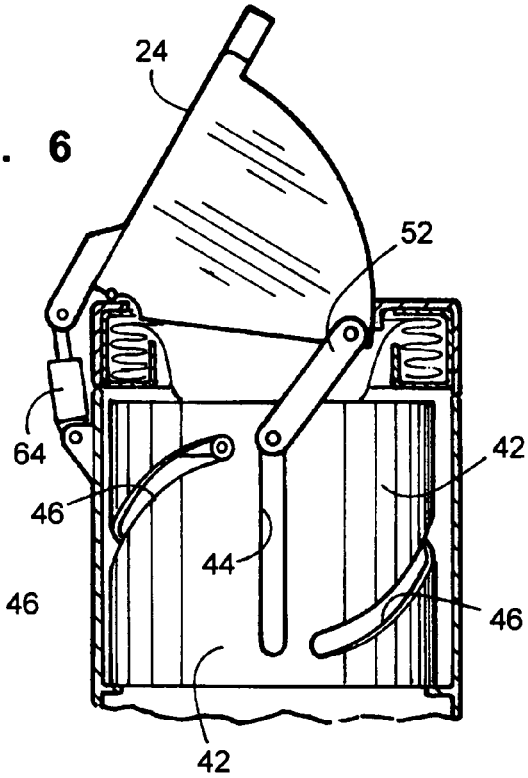
FIG. 8 is a partially cut-away view of the embodiment of FIG. 6, when the lid is in an open condition.
Figure 9:
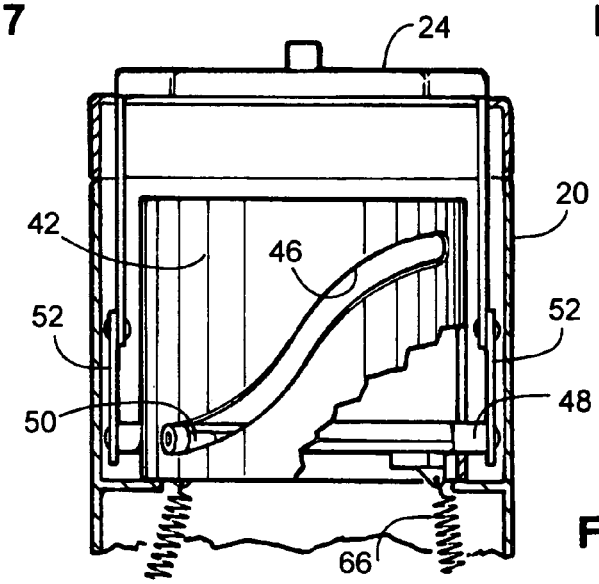
FIG. 9 is a partially cut-away view of a still further embodiment of the invention, wherein movement of the iris is facilitated by springs.
Figure 10A:
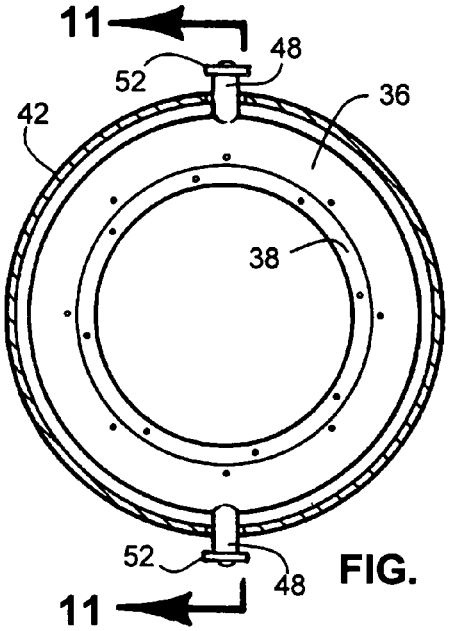
FIG. 10A is a top view of the iris, wherein the web connecting the iris disks is not shown.
Figure 10B:
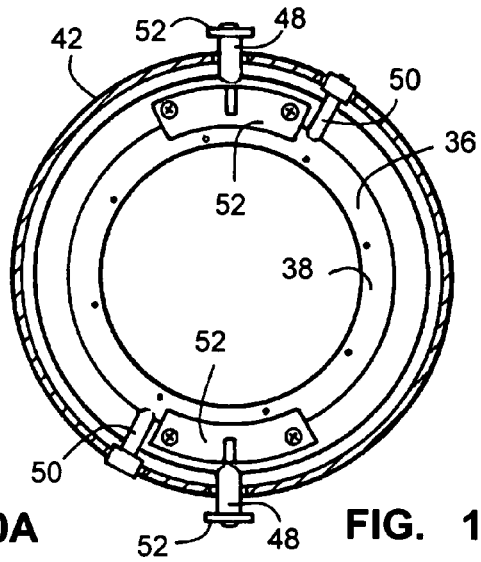
FIG. 10B is a bottom view of the iris, wherein the web connecting the iris disks is not shown.
Figure 11:
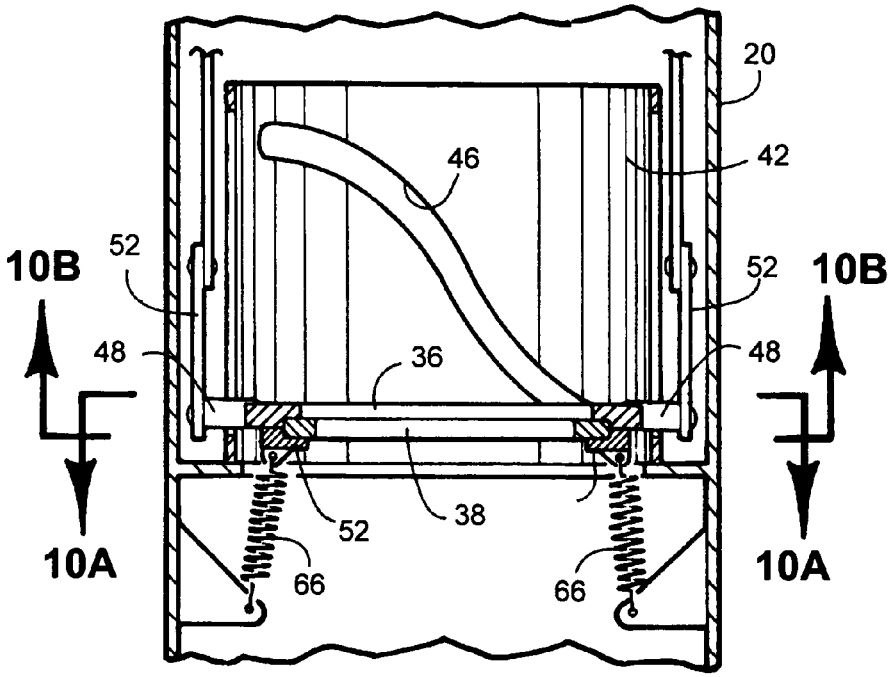
FIG. 11 is another partially cut-away View of the embodiment of FIG. 9.

As shown in FIGS. 6–8, an actuator 64 may be connected to lid 24 facilitating the opening and closing of lid 24. Actuator 64 can be electric, for instance, a magnetic solenoid or an electric motor, or may be pneumatic.

Turning now to FIGS. 9 and 10A, 10B and 11, one or more springs 66 may also be connected to iris 34. In one embodiment, when lid 24 is opened and iris 34 moves in the direction of lid 24, springs 66 extend and are tensed. When lid 24 is successively closed, springs 66 retract to the rest position and facilitate the movement of iris 34 in the direction of waste chamber 22.

In yet another embodiment, operation of the invention is further facilitated by the addition of a sensor 70 that causes the lid to displace, that is, to open and/or close, when a hand is detected and an electric signal is sent to actuator 64. Sensor 70 may be of a type detecting motion or of a type detecting heat. Alternatively, an electric or pneumatic signal may be sent to actuator 64 by means of a hand switch or a pedal.

In a still further embodiment, a fastening device is added to the first embodiment to provide a permanent sealing of each portion of flexible tubing 32, within which waste in encapsulated. Such fastening devices include heat-sealing devices, and devices that dispense mechanical clasps, such as the Kwick Lok® clasps commonly used in the United States to fasten bread bags. In this embodiment, the fastening device is powered electrically, but in another embodiment the fastening device may be powered mechanically.

While the invention has been described in connection with certain embodiments, it is not intended to limit the scope of the invention to the particular forms set forth, but on the contrary, it is intended to cover such alternatives, modifications, and equivalents as may be included within the spirit and scope of the invention as defined by the appended claims.

We claim:

1. A waste disposal system with flexible tubing comprising:

a container defining a waste chamber for receiving waste;

a lid connected to the container and movable between an open condition, in which access to the container is provided, and a closed condition, in which the container is covered;

an iris comprising a first disk, a second disk and a web, wherein the first disk and the second disk are ring shaped, parallel and coaxial, wherein the web connects the first disk and the second disk, and wherein the iris is structured to rotate from an open position, in which waste can flow through the iris, to a closed position, in which flow of waste through the iris is hindered and wherein said iris is structured to move toward and away from the lid;

a cartridge of flexible tubing removably situated in the container, wherein the flexible tubing extends from the cartridge through the iris into the waste chamber and is arranged to receive waste therein; and a guide for guiding and causing the iris to move from the open position to the closed position by generating a relative rotation between the first disk and the second disk, further causing the iris to twist and cinch the flexible tubing and to enclose the held waste, and still further causing the iris to move in a direction opposite to the lid and to carry the held waste into the waste chamber.

2. The waste disposal system with flexible tubing of claim 1, wherein the web comprises a plurality of string segments.

3. The waste disposal system with flexible tubing of claim 2, wherein the string segments are parallel.

4. The waste disposal system with flexible tubing of claim 3, wherein the angular distance between the attachment points of one of the string segments on the first disk and on the second disk is larger than the angular distance between the attachment point of one of the string segments on the first disk and the attachment point of the consecutive string segment on the first disk.

5. The waste disposal system with flexible tubing of claim 4, wherein the iris moves from the open position to the closed position when the relative rotation of the first disk and of the second disk is approximately 110 degrees.

6. The waste disposal system with flexible tubing of claim 1, wherein:

the guide system comprises a cylindrical structure housing the iris;

the cylindrical structure comprises a slot system and a groove system;

the slot system comprises one or more slots essentially parallel to the common axis of the first disk and of the second disk, each of the one or more slots housing a first pin connected to the first disk;

the groove system comprises one or more grooves running in a spiral pattern along the cylindrical structure, each of the one or more second grooves housing a second pin connected to the second disk; and each of the first pins is connected to the lid, wherein a movement of the lid from the open position to the closed position causes a movement of the first pins along the slots and a movement of the iris in a direction opposite to the lid, and wherein the movement of the first disk causes a movement of the second pins in the direction of the one or more grooves and the closing of the iris.

7. The waste disposal system with flexible tubing of claim 6, further comprising retainers connecting the first disk and the second disk.

8. The waste disposal system with flexible tubing of claim 1, further comprising one or more springs connected to the iris, the one or more springs being tensed when the iris moves in the direction of the lid and returning to their rest position when the iris moves in the direction opposite to the lid.

9. The waste disposal system with flexible tubing of claim 1, further comprising a door on the wall of the container for the removal of the flexible tubing.

10. The waste disposal system with flexible tubing of claim 1, further comprising a drawer in the container for the removal of the flexible tubing.

11. The waste disposal system with flexible tubing of claim 1, further comprising an actuator connected to the lid and causing the lid to displace.

12. The waste disposal system with flexible tubing of claim 11, wherein the actuator comprises a magnetic solenoid.

13. The waste disposal system with flexible tubing of claim 11, wherein the actuator comprises an electric motor.

14. The waste disposal system with flexible tubing of claim 11, wherein the actuator is activated through a sensor.

15. The waste disposal system with flexible tubing of claim 11, wherein the actuator is activated through a hand switch.

16. The waste disposal system with flexible tubing of claim 11, wherein the actuator is activated through a pedal.

17. The waste disposal system with flexible tubing of claim 1, further comprising a fastening device that fastens the flexible tubing approximately in the area where the flexible tubing is cinched.

18. The waste disposal system with flexible tubing of claim 17, wherein the fastening device comprises a heat-sealing device.

19. The waste disposal system with flexible tubing of claim 17, wherein the fastening device fastens the flexible tubing with a mechanical clasp.

* * * * *